United States Patent [19]

Lane

[11] Patent Number: 4,610,594

[45] Date of Patent: Sep. 9, 1986

[54] CONTAINER CONVEYOR SYSTEM

[75] Inventor: Raymond P. Lane, Burlington, Canada

[73] Assignee: Dominion Chain Inc., Stratford, Canada

[21] Appl. No.: 689,344

[22] Filed: Jan. 7, 1985

[51] Int. Cl.[4] ..... B63B 27/12; B65G 57/03

[52] U.S. Cl. ..... 414/71; 187/26; 212/213; 254/399; 294/81.1; 294/81.54; 414/140; 414/145

[58] Field of Search ..... 414/70, 71, 140, 145, 414/267, 281; 212/205, 213, 214, 220, 221; 114/255, 260; 187/20, 23, 26; 254/285, 337, 399; 294/81.1, 81.41, 81.5, 81.54

[56] References Cited

U.S. PATENT DOCUMENTS

| | | | |
|---|---|---|---|
| 1,745,049 | 1/1930 | Systrom | 254/285 X |
| 2,541,893 | 2/1951 | Speer | 414/140 |
| 3,034,659 | 5/1962 | Willison et al. | 414/140 X |
| 3,946,881 | 3/1976 | Ludvigsen | 414/140 |
| 4,043,285 | 8/1977 | Nordstrom | 414/140 X |
| 4,398,761 | 8/1983 | Hanson et al. | 294/81.6 X |
| 4,498,584 | 2/1985 | Newbury | 206/510 |

FOREIGN PATENT DOCUMENTS

| | | | |
|---|---|---|---|
| 52-51650 | 4/1977 | Japan | 212/213 |
| 52-51652 | 4/1977 | Japan | 212/213 |

*Primary Examiner*—Leslie J. Paperner

*Attorney, Agent, or Firm*—Hirons, Rogers & Scott

[57] ABSTRACT

The invention provides structure consisting of tracks carrying a transporter which moves horizontally on the tracks. A hoist is suspended from the transporter and the hoist includes an elevator for picking up containers at engagement points above the points of suspension of the elevator. Pairs of uprights guide the elevator to maintain stability and the transporter includes guides for alignment with the uprights so that the elevator can move out of the uprights and between the guides for movement horizontally with the transporter with the guides maintaining stability.

8 Claims, 4 Drawing Figures

CONTAINER CONVEYOR SYSTEM

FIELD OF THE INVENTION

This invention is related to improvements in material handling structures for use in manipulating containers within a confined space such as the hold of a ship and is intended to permit more containers to be stored in the available space.

REVIEW OF THE PRIOR ART

Containerization of materials for storage in restricted spaces is well known. It is common for instance to stack containers in buildings where headroom is restricted and where the containers should be stacked as high as possible to take maximum advantage of the height of the building. Consequently, any crane system used should have minimum height requirements. Another example of a restricted space for storing containers is the hold of a ship. The present invention will be described with reference to a ship's hold but is not to be restricted to such use.

An example of containerization in ships is the handling of freshly caught fish which are packed in ice to preserve them while the ship is at sea and until the fish can be delivered to a processing plant. It has been proposed to use relatively small containers for this purpose to avoid the damage and bruising of the fish. These containers can also be used to ship ice from the processing plant to the trawlers at sea.

Vessels employed in the fishing industry are relatively small and the space available in the holds has to be used to maximum advantage. Consequently, if material handling equipment is to be used, it has to be arranged to occupy as little space as possible and not restrict vertical stacking.

An example of a prior art cargo-handling device is shown in U.S. Pat. No. 2,541,893 which discloses a device comprising a horizontally movable crane mounted in a vessel entirely beneath the main deck and extensible out through a hatch in the side of the vessel. The structure can pick up and deliver cargo from the ship directly to the dockside. Another exemplary patent is U.S. Pat. No. 3,946,881 which discloses a somewhat similar arrangement intended to operate through access openings in the sides of the ship. Both patents disclose cranes with which the movable engagement portion operates entirely beneath the crane beams on which the crane trolley runs. This is typical of cranes because for reasons of stability, the object being picked up has its centre of gravity below the crane hook. Such arrangements necessitate providing space for the structure above the hook and make it impossible to use this space to store containers.

SUMMARY OF THE INVENTION

It is an object of the present invention to provide a new structure for handling containers within an enclosed space in which the head room is restricted.

According to one of its aspects, the invention provides structure consisting of tracks carrying a transporter which moves horizontally on the tracks. A hoist is suspended from the transporter and the hoist includes an elevator for picking up containers at engagement points above the points of suspension of the elevator. Pairs of uprights guide the elevator to maintain stability and the transporter includes guides for alignment with the uprights so that the elevator can move out of the uprights and between the guides for movement horizontally with the transporter with the guides maintaining stability.

DESCRIPTION OF THE DRAWINGS

A preferred embodiment of the invention is shown in the drawings in which.

Figure 1:
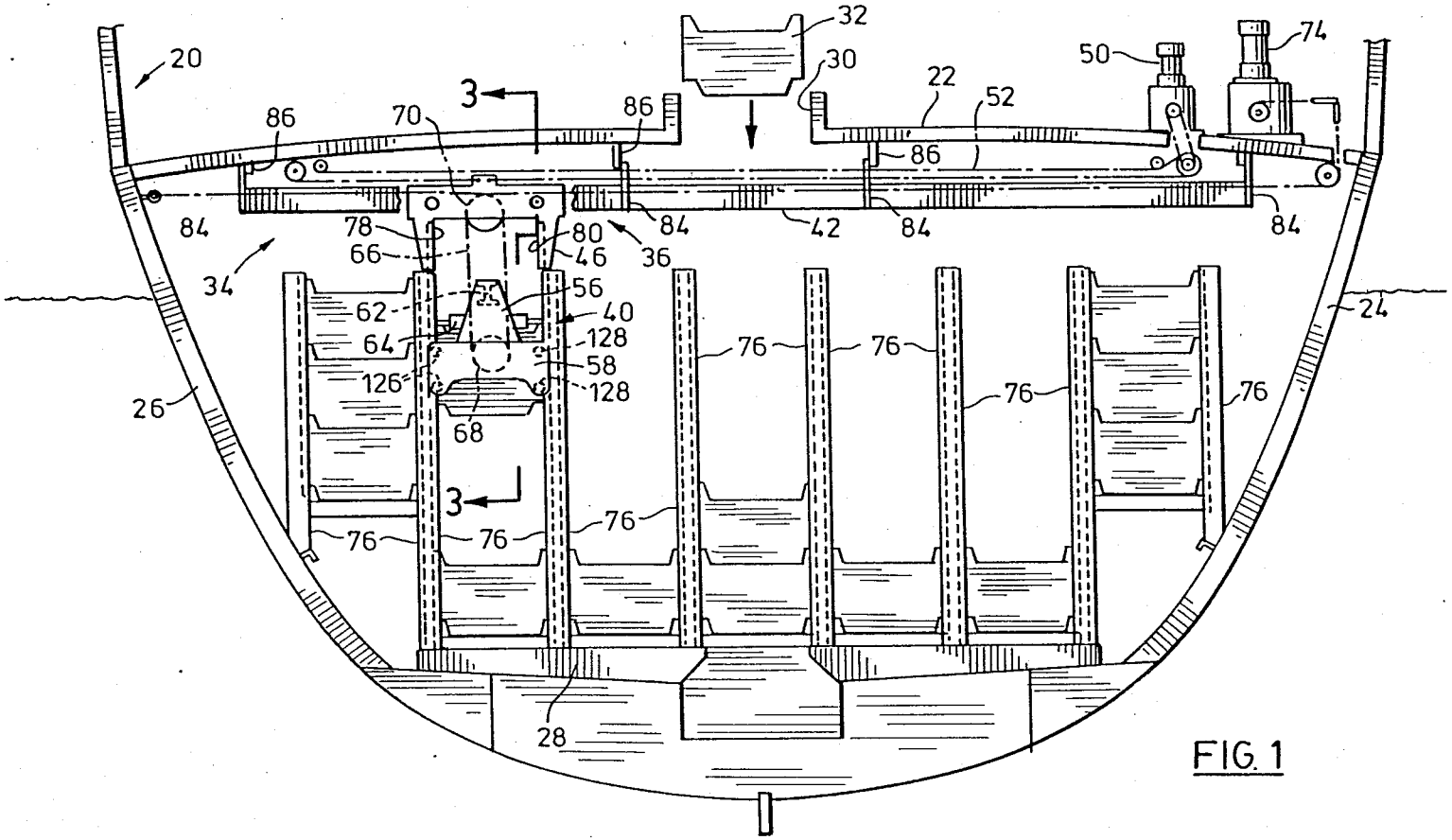
FIG. 1 is a transverse section through the hold of an exemplary ship used to illustrate a confined space containing a preferred embodiment of the structure for moving containers in the hold, structure being shown as a container is being delivered to a selected location.

Reference is made first to FIG. 1 which illustrates a preferred embodiment of structure according to the invention installed in an exemplary location, i.e. the hold of a ship designated generally by the numeral 20. The hold is defined by a deck 22, extending between sides 24, 26 of the hull of the ship and defined at its bottom by a platform structure above the bilge. The deck 22 defines a central opening 30 providing access into the hold and through which modular containers such as container 32 can be loaded into the hold using the moving structure designated generally by the numeral 34.

Figure 2:
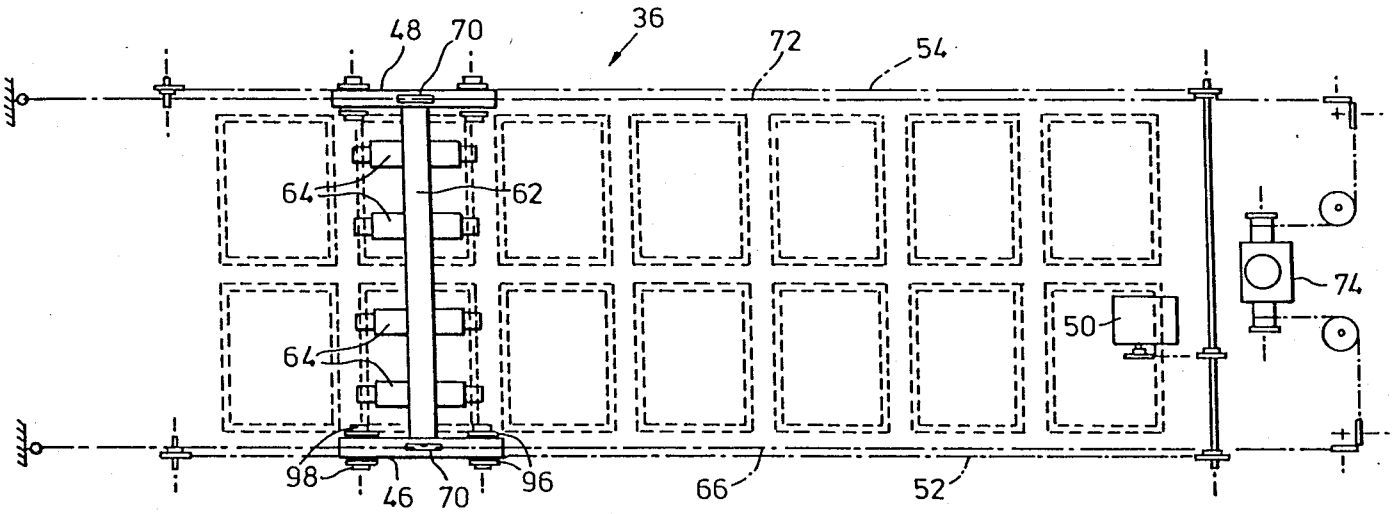
FIG. 2 is a diagrammatic plan view illustrating control of the structure for moving the containers.

As seen in FIGS. 1 and 2, the moving structure 34 consists essentially of a transporter designated generally by the numeral 36 and a hoist designated generally by the numeral 40. The transporter includes a pair of overhead tracks 42, and 44 (FIG. 4) straddling opening 30 carrying respective cars 46, 48 which are driven by a motor and gearbox assembly 50 linked through a drive chain to a pair of endless chains 52, 54 coupled to the cars as will be described.

The hoist 40 includes an elevator 56 having end assemblies 58, 60 connected by a carrier beam 62 positioned at the upper extremity of the end structures. This beam carries engagement structures 64 adapted to be coupled manually or by some other means to the containers 32 in conventional fashion.

The elevator 56 of the hoist 40 is suspended by a cable 66 which extends around a sheave 68 in the elevator 56 and around a double sheave 70 mounted in the car 46. This structure is repeated for the car 48 and a corresponding end assembly using a corresponding cable 72. The cables 66 and 72 are led by suitable guide pulleys to a motor and gearbox assembly 74 which carries winding drums for the cables.

The end assemblies 58, 60 are guided in pairs of uprights 76 when the elevator 56 is in the general position shown in FIG. 1 and then by pairs of guides 78, 80 on the car 46 and by corresponding guides on the car 48. Consequently, it is possible to lift the containers to the point where the elevator 56 is carrying the containers and the end assemblies are no longer in engagement with the uprights 76 so that the transporter 36 can then move the containers along the tracks to align the guides 78, 80 with other pairs of uprights 76 for placing the container in different positions in the hold as will be described more fully after completing the description of the drawings.

The general overview given with reference to FIGS. 1 and 2 will now be complemented by describing more details of the structure. Having completed this, use of the structure to place containers in the hold of the exemplary ship will be described.

Figure 3:
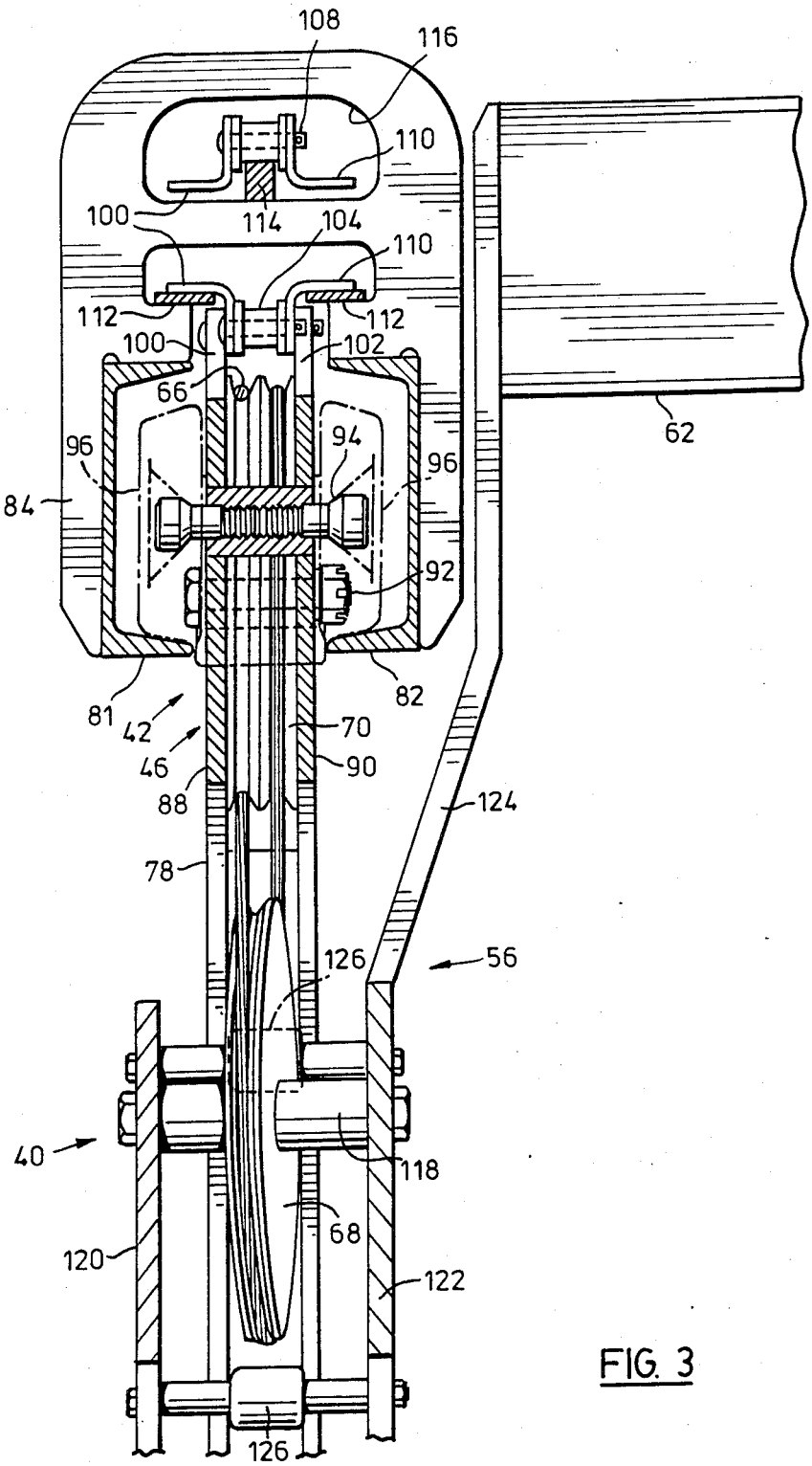
FIG. 3 is a sectional view generally on lines 3—3 of FIG. 1 and drawn to a larger scale, the structure being shown in a raised position.

Reference is made next to FIG. 3 to describe parts mentioned earlier in more detail. The track 42 consists of a pair of inwardly facing U-channel section members 81, 82 attached to one another by a series of shaped plates 84 to which the members are welded. As seen in FIG. 1 these plates are suspended by hangers 86 from the deck.

The car 46 consists of a pair of side plates 88, 90 containing the double sheave 70 mounted on an axle assembly 92. A further pair of axle assemblies 94 (one of which is shown) support respective pairs of wheels 96 and 98 (FIG. 2) for carrying the car in the track.

Side plates 88, 90 have central upstanding projections 100, 102 which terminate in attachments to a chain element 104 forming part of the endless chain 52 which also includes, above link 104, a further exemplary chain element 108. It will be seen that the links include L-shaped support elements 110 to allow the chain to be supported on suitable pads 112 welded to the shaped plates 84. Similarly a rubbing strip 114 is provided for the link 108 as it passes through an opening 116 in the plate so that the top and bottom flights of the chain are supported to minimize catenary action and possible flogging as the ship pitches and rolls.

It will be evident from FIG. 3 that the car 46 can be moved with reference to the track 42 by driving the chain 52 (FIG. 2). Movement in one direction will move the car longitudinally in a corresponding direction, and by reversing the drive, the car will be moved longitudinally in the opposite direction.

The hoist 40 is suspended and includes the double sheave 70. As seen in FIG. 3, the cable 66 passes over one of the tracks in the double sheave, extends downwardly to the sheave 68 and returns to the other track leaving in the opposite direction to that from which the cable came. Because of the double sheave and the proximity of the sheave 68 in use, it is necessary to angle the sheave 68 as shown. A special axle assembly 118 is provided for the purpose. This assembly is supported between an outer plate 120 and an inner plate 122 which has a cranked upward extension 124 terminating at the beam 62 to support the beam.

The plates 120, 122 carry pairs of roller assemblies 126 and 128 (see FIG. 1) and these roller assemblies locate in the guides 78, 80 which have a channel section for this purpose. Similarly, the uprights 76 have back to back channel sections for guiding the rollers when the guides 78, 80 are in registration with a pair of uprights so that the rollers can pass freely between the uprights and the guides.

Figure 4:
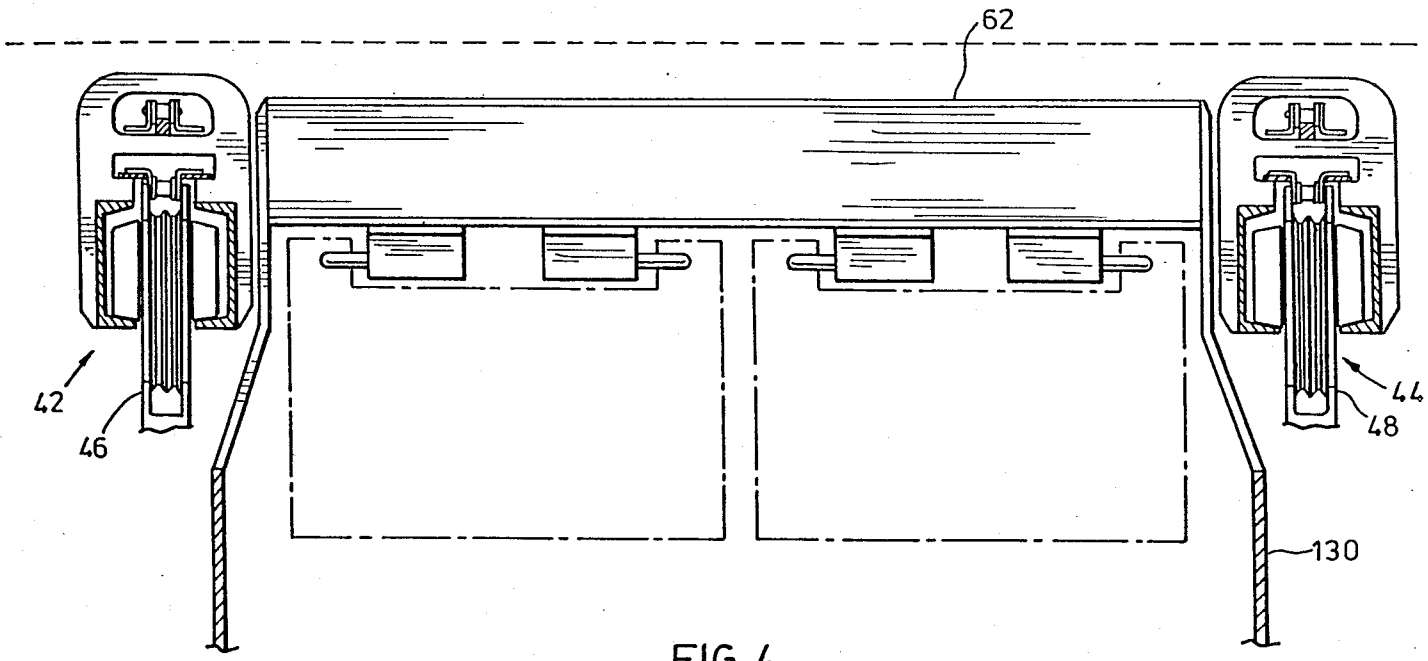
FIG. 4 is a partial view similar to FIG. 4 and illustrating more of the components of the structure.

It will be evident that the elevator 56 can be moved between pairs of uprights supported by the cable 66. The arrangement is better seen in FIG. 4 which corresponds partially to FIG. 3 drawn to a smaller scale and showing both cars 46, 48. As seen in FIG. 4 the beam 62 is supported at its ends by the plate 122 and corresponding plate 130 forming part of the other end assembly. The beam is proportioned to carry two containers as illustrated in ghost outline although it could of course be made to carry more. It is significant to note that the point of suspension of the containers is above the point of suspension of the elevator at sheave 68. The beam would be unstable were it not for the end assemblies being guided in the uprights or in the guides 78, 80 (FIG. 1) as the case may be. As a result, because the point of suspension is above the sheave 68 maximum use can be made of the head room. This is made possible by having the beam 62 extend above the tracks 42, 44 when the containers are elevated to their maximum height.

Reference is again made to FIG. 1 to describe how the structure is used to stack containers in the hold of a ship. The container 32 is lowered by an external crane into a location between the pair of uprights 76 aligned with the opening 30. Containers can be added at this location by external crane for movement by a structure into other locations between other pairs of uprights. The hoist is first used to lift the elevator into position between the guides 78, 80 so that the transporter can then move carrying the hoist to the location under the opening 30. The hoist then lowers the elevator into contact with the containers, the engagement structures are activated to attach to the containers, and then the hoist is used to lift the elevator complete with containers into position above the uprights and in engagement with the guides 78, 80. The transporter can then be used to move the containers to a position such as that shown in FIG. 1 where the elevator is lowered guided by a pair of uprights until the containers are positioned on top of the existing containers at that location. This procedure is repeated and of course, when loading a ship, containers would be placed first to one side then to the other to maintain balance.

When unloading the procedure is reversed using an external crane to lift the containers 32 from the central location.

It would of course be possible to introduce the containers at a different location either by providing an opening at a different point or even in a building the containers could be positioned in the last location to the side by a forklift truck or other similar device and the structure could then be used to transport them from that location. All such concepts are within the scope of the invention.

It will also be evident that the structure can be accommodated in a variety of enclosed spaces where headroom is at a premium. Such uses are within the scope of the invention as described and claimed.

The embodiments of the invention in which an exclusive property or privilege is claimed are defined as follows:

1. Structure for loading modular containers to stack the containers in a confined space between a floor and a roof, the structure comprising:

parallel overhead tracks extending horizontally, the tracks being suspended from the roof;

a transporter including a pair of cars mounted one on each of the tracks for movement along the tracks, and drive means coupled to the cars to move the cars in unison with the cars at respective corresponding locations on the tracks;

uprights spaced apart in pairs below the respective tracks;

a hoist including an elevator having a pair of end assemblies one below each of the cars, each of the end assemblies being adapted to be stabilized and guided vertically by one of the pairs of uprights, a beam extending between the end assemblies and including engagement means for attachment to at least one container for transporting the container, and cable means suspending the elevator from the transporter and operable to move the elevator vertically and to maintain the level of the elevator when the transporter is moved along the tracks, the cable means suspending the elevator from a point on the elevator substantially below the engagement means; and each of the transporter cars also including a pair of downwardly extending guides spaced apart by an amount corresponding to the spacing between the pairs of uprights for alignment with corresponding uprights adjacent the uprights to provide extensions of the uprights so that when the hoist elevator moves upwardly to its uppermost location it travels stabilized by the uprights and then transfers to the guides where it travels in the guides alone to clear the uprights and to permit the transporter to then move the hoist horizontally into alignment with other pairs of uprights thereby permitting moving a container located within the guides from a location above one pair of uprights into another position above other uprights for lowering between these other uprights carried by the elevator as it is stabilized first by the guides and then by said other uprights.

2. Structure as claimed in claim 1 in which the engagement means is suspended below the beam.

3. Structure as claimed in claim 1 in which the track straddles an opening in the roof through which containers enter and leave the confined space.

4. Structure as claimed in claim 1 in which the beam is attached to the end assemblies adjacent the upper extremities of the end assemblies.

5. Structure for moving containers from a first location between parallel first uprights to a second location between parallel second uprights, the structure comprising:

a pair of tracks extending horizontally above the uprights;

a transporter having two cars movable along respective ones of the tracks, each car including a pair of guides extending vertically downwards for alignment with selected pairs of the uprights in proximity with the uprights to form continuations of the uprights; and a hoist having two end assemblies adapted to be located in pairs of uprights and in the guides for movement vertically, each of the end assemblies being below a corresponding one of the cars, a beam attached at its ends to the end assemblies at the tops of the end assemblies, engagement means suspended from the beam for releasable connection to the containers, the beam being positionable between the cars with the elevator lifted to an uppermost position where the end assemblies are clear of the first upright and located between respective pairs of guides of the end assemblies so that the transporter can move horizontally to align the guides with the second uprights with a container between the guides whereby the hoist can then be used to lower the container with the end assemblies moving in the parallel second uprights.

6. Structure as claimed in claim 5 in which the hoist includes sheave means coupled to the cars and to the end assemblies and cable coupled for passing around the sheave means to suspend the end assemblies from the cars.

7. Structure as claimed in claim 6 in which the sheave means comprises upper sheaves attached to the cars and lower sheaves attached to the end assemblies, the centre line of the lower sheaves being below the engagement means.

8. Structure for transporting modular containers used in the fishing industry to transport fish to port, the ship having a hold defined by a deck having a central opening, a floor and sides of the ship, the structure comprising a pair of tracks suspended from the underside of the deck and straddling the opening, the tracks extending across the beam of the ship;

a transporter having a pair of cars mounted one on each of the tracks for movement along the tracks, and drive means mounted on the ship and coupled to the cars to move the cars in unison with the cars at respective corresponding locations on the tracks;

uprights spaced apart in pairs below the respective tracks and mounted on the floor of the hold, the uprights terminating at their upper extremities short of the track by an amount no greater than the height of the container;

a hoist including an elevator having a pair of end assemblies one below each of the cars, each of the end assemblies being adapted to be guided vertically by one of the pairs of tracks, a beam extending between upper ends of the end assemblies and including engagement means suspended from the beam for attachment to at least one container for transporting the container, and cable means suspending the elevator from the transporter and operable to move the elevator vertically and to maintain the level of the elevator when the transporter is moved along the tracks, the cable means suspending the elevator from a point on the elevator substantially below the engagement means; and each of the transporter cars also including a pair of downwardly extending guides spaced apart by an amount corresponding to the spacing between the pairs of uprights for alignment with corresponding uprights in proximity with the uprights to provide extensions of the uprights so that as the hoist elevator moves upwardly to its uppermost location the end assemblies enter the guides and are guided in the guides along to permit the transporter to move the hoist horizontally into alignment with other pairs of uprights thereby permitting moving a container from a location between one pair of uprights into another position between other uprights.

* * * * *